US007160164B2

(12) United States Patent
Lin

(10) Patent No.: US 7,160,164 B2
(45) **Date of Patent: *Jan. 9, 2007**

(54) BODY BOARD

(75) Inventor: Joseph Lin, Torrance, CA (US)

(73) Assignee: Pacific Link Holdings Corp.

( * ) Notice: Subject to any disclaimer, the term of this patent is extended or adjusted under 35 U.S.C. 154(b) by 0 days.

This patent is subject to a terminal disclaimer.

(21) Appl. No.: 11/378,524

(22) Filed: Mar. 18, 2006

(65) Prior Publication Data

US 2006/0148343 A1 Jul. 6, 2006

Related U.S. Application Data

(63) Continuation of application No. 10/606,433, filed on Jun. 25, 2003, now Pat. No. 7,029,349.

(51) Int. Cl.
*B63B 1/00* (2006.01)

(52) U.S. Cl. ..... 441/65; 441/74

(58) Field of Classification Search ..... 441/65, 441/74; 114/345

See application file for complete search history.

(56) References Cited

U.S. PATENT DOCUMENTS

| | | | | |
|---|---|---|---|---|
| 3,733,381 | A | 5/1973 | Willette et al. | |
| 3,755,063 | A | 8/1973 | Massey et al. | |
| 4,092,198 | A | 5/1978 | Scher et al. | |
| 4,264,657 | A | 4/1981 | Tollette | |
| 4,281,040 | A | 7/1981 | Santiago | |
| 4,457,729 | A | 7/1984 | Peerlkamp | |
| 4,726,986 | A | 2/1988 | Cannady, Jr. et al. | |
| 4,806,412 | A | 2/1989 | Wank et al. | |
| 4,921,513 | A | 5/1990 | Parten | |
| 5,114,370 | A | 5/1992 | Moran | |
| 5,211,593 | A | 5/1993 | Schneider et al. | |
| 5,238,434 | A | 8/1993 | Moran | |
| 5,273,470 | A | 12/1993 | Sneddon et al. | |
| 5,275,860 | A | 1/1994 | D'Luzansky et al. | |
| 5,503,921 | A | 4/1996 | Chang et al. | |
| 5,647,784 | A | 7/1997 | Moran | |
| 5,658,179 | A | 8/1997 | Glydon et al. | |
| 5,800,226 | A | 9/1998 | Szabad et al. | |
| 6,106,345 | A | 8/2000 | Yeh | |
| 6,955,576 | B1 * | 10/2005 | Yeh | 441/65 |
| 6,988,920 | B1 * | 1/2006 | Yeh | 441/65 |
| 2002/0167136 | A1 | 11/2002 | Lehr et al. | |
| 2003/0224675 | A1 | 12/2003 | Yeh | |

FOREIGN PATENT DOCUMENTS

| | | |
|---|---|---|
| WO | WO 95/11802 | 5/1995 |
| WO | WO 95/12487 | 5/1995 |

* cited by examiner

*Primary Examiner*—Lars A. Olson
(74) *Attorney, Agent, or Firm*—Raymond Sun

(57) ABSTRACT

A body board, or sports board, for recreational activities on snow or on water is disclosed. The board has a foam core, a binding layer laminated on top of one surface of the foam core, a printed graphics layer laminated on top of the binding layer and a clear protection layer laminated on top of the printed graphics layer. On the bottom surface of the board, the foam core can have a bottom foam layer applied thereto and a slick skin applied onto the outside of the bottom foam layer. The bottom surface can also have the graphics layer and binding layer applied between the bottom foam layer and the slick skin to provide an additional graphics side.

13 Claims, 2 Drawing Sheets

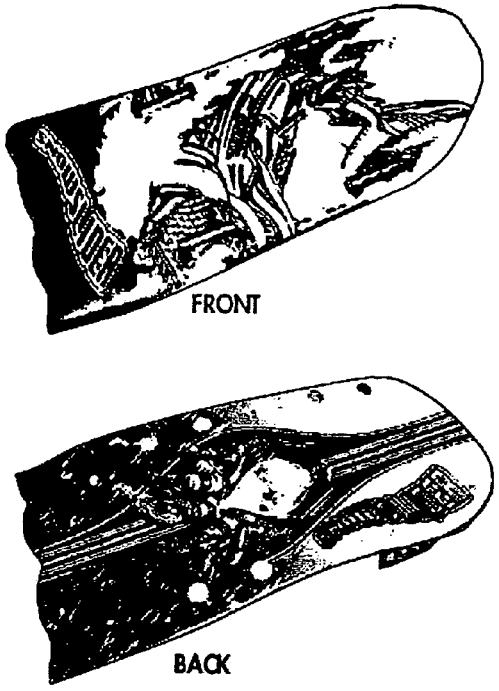
Figure 3 (a) and 3 (b)
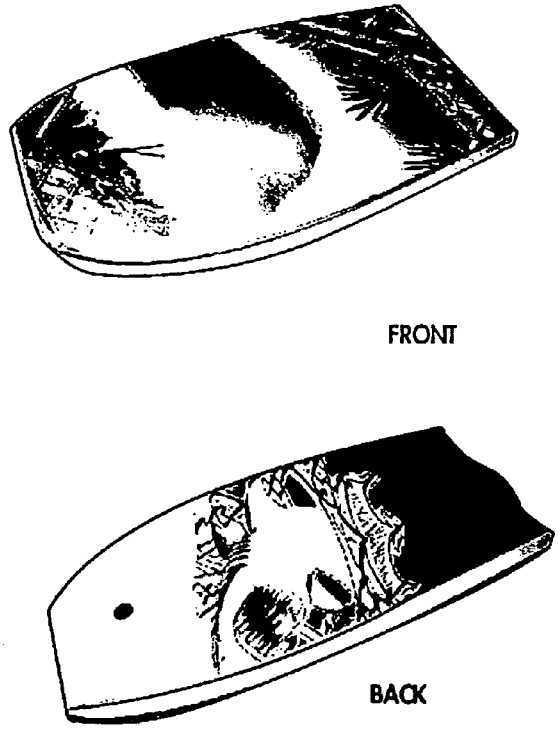
Figure 3 (c) and 3(d)

BODY BOARD

RELATED CASES

This is a continuation of Ser. No. 10/606,433, entitled "Body Board", filed Jun. 25, 2003, now U.S. Pat. No. 7,029,349 whose disclosures are incorporated by this reference as though fully set forth herein.

RELATED FIELD

The present invention relates to a body board, or sports board, having protective layers heat-laminated onto the surfaces of the board so as to protect the board from corrosion and to provide decoration.

ART BACKGROUND

Body boards have become a popular recreational device for individuals to glide on a water or snow surface. Body boards, also known as sports boards, probably had their roots in conventional surfboards, although body boards are shorter in length and lighter in weight because of the material used. Body boards are also more flexible so that a user can maneuver the board while using the board in water, or on snow.

One conventional body board has been described in a US patent, issued to Yeh, U.S. Pat. No. 6,106,345 ('345 patent). The disclosure of the '345 patent is incorporated by reference as if fully set forth herein. The board according to the '345 patent has an expanded polyethylene ("PE") core with a protection layer heat-laminated around the outside of the board. The protection layer also has ultraviolet inhibitor and anti-oxidant additives, in order to protect the protection layer fresh for a long time. In addition to providing protection to the board, the protection layer can be made into three separate strips of different colors and the three strips are heat-laminated on the top of the board. Such coloring strips allow the board to have color variations in its exterior. However, this approach provides only a way to add limited color variations to the board.

Another body board is described in US Patent Publication, No. US 2002/0167136 by Lehr et al., where a solid sheet skin is laminated directly to the expanded foam core without using any adhesive layer in-between. However, such boards do not seem to provide any improved ways to decorate the exterior of the boards, other than still relying on the conventional screen-printing technique, which tend to fade in the sun after repeated usage.

It is therefore desirable to provide a new and improved sports or body board which is designed to protect the board from corrosion on a snow or water surface.

It is also desirable to provide a new body board that can be made more aesthetically pleasing and attractive to the would-be buyers. The boards effectively become a symbol of the user's identity and individuality.

It is further desirable to provide a new body board that protects its graphics and designs from the outside environment.

SUMMARY OF THE PRESENT INVENTION

A body board, or sports board, for recreational activities on snow or on water is disclosed. The board has a foam core, a binding layer laminated on top of one surface of the foam core, a printed graphics layer laminated on top of the binding layer and a clear protection layer laminated on top of the printed graphics layer. On the bottom surface of the board, the foam core can have a bottom foam layer applied thereto and a slick skin applied onto the outside of the bottom foam layer.

Another embodiment of the present invention has a foam core, a deck foam layer applied on top of one surface of the foam core, a binding layer laminated on top of the deck foam layer, a printed graphics layer laminated on top of the binding layer and a clear protection layer laminated on top of the printed graphics layer. On the other surface, i.e. the bottom surface, of the foam core, a bottom foam layer is applied onto bottom surface of the foam core. Another binding layer is laminated onto the bottom foam layer, followed by another printed graphics layer laminated onto the binding layer. Finally, a slick bottom protection layer is applied onto the printed graphics layer.

BRIEF DESCRIPTION OF THE DRAWINGS

FIGS. 3 (*a*)–(*b*) illustrates the front and back sides of a finished body board for sliding on a snow surface.

FIGS. 3 (*c*)–(*d*) illustrates the front and back sides of another finished body board.

DETAILED DESCRIPTION OF THE PREFERRED EMBODIMENTS

Figure 1:
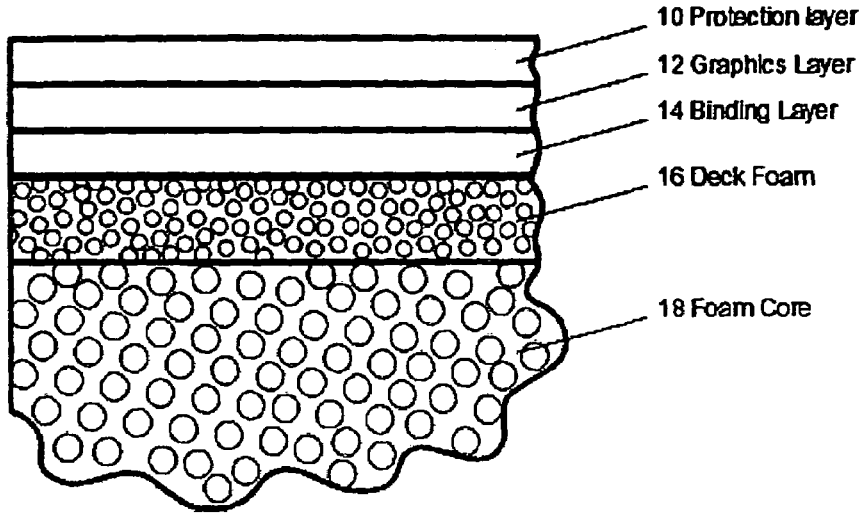
FIG. 1 illustrates an exemplary top surface portion of the body board is illustrated in a partial cross-sectional view.

A body board, or sports board, for snow or ocean recreational activities is disclosed. Reference is to FIG. 1, where a top surface portion of an exemplary body board is illustrated in a partial cross-sectional view. The body board in accordance with the present invention has a foam core 18, a deck foam 16 laminated on top of foam core 18, a binding layer 14 laminated on top of the deck foam 16, a printed graphics layer 12 laminated on top of the binding layer 14, and a generally clear protection layer 10 on top of the printed graphics layer 12.

The foam core 18 can be a type of expanded foam or polyethylene ("PE") material, having a thickness of about 25 mm. Preferably, the foam core 18 has a density, in the general ranges of 1.9 PCF (pound per cubic feet) and 2.1 PCF. The deck foam 16 preferably has a thickness of about 3 mm, and may have a density of about 6 PCF, such that the deck foam is harder and stiffer than the foam core. However, it should be understood by those skilled in the art that a body board in accordance with the present invention might have only one type of foam, or multiple types of foam at its core.

The binding layer 14, which serves as an adhesive to bond the printed graphics layer 12 to the foam, preferably has a thickness of about 0.3 mm. The printed graphics layer, which can be a printed film material printed by roller, has a thickness of about 0.2 mm. The protection layer 10, which is preferably clear, or transparent, so that the designs on the graphics layer underneath can be seen from the outside, has a thickness of about 0.3 mm. It should be apparent to those skilled in the art that the thickness of each layer may be modified without departing from the scope and spirit of the present invention. Additionally, the clear protection layer 10 may have a rough or serrated surface to prevent the user from slipping, and to provide a better grip.

It should be pointed out that a graphics layer may be printed on a film by running the film consecutively through a set of rollers, with each roller adding a particular color for the design. For example, to print a 4-color graphics film, at least 4 rollers are needed. It should be apparent to those skilled in the art that printing a multi-color design onto a film is similar to printing a multi-color design on fabric, since the same printing machines can generally be used on different materials.

Additionally, the graphics layer (film) may be heat laminated or glued onto the foam board, which itself may be PE (polyethylene) foam, PVC (polyvinyl chloride) foam, EVA (ethylene vinyl acetate) foam, PP (polypropylene) foam, or the combination thereof. As can be appreciated by those skilled in the art, a composite or combination foam can be made by laminating or gluing different kinds of foam materials together. Additionally, some boards are made by "expanding" the material into shape, such as those commonly known as EVA body board or EPS (expanded polystyrene) body board.

Figure 2:
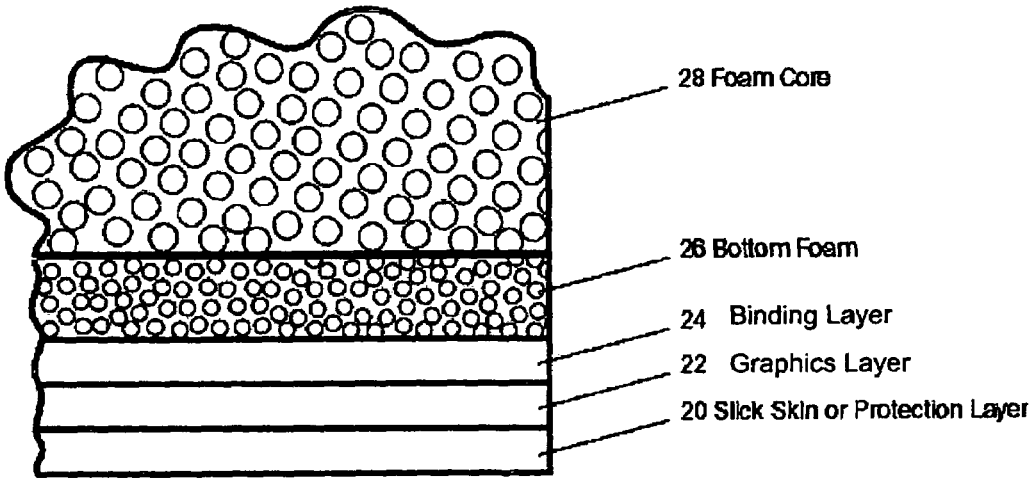
FIG. 2 illustrates an exemplary bottom surface portion of the body board is illustrated in a partial cross-sectional view.

Reference is to FIG. 2, where a bottom surface portion of the exemplary body board is illustrated in a partial cross-sectional view. The body board in accordance with the present invention has a foam core 28, a bottom foam 26 laminated on the outside surface of foam core 28, a binding layer 24 laminated on the outside surface of the bottom foam 26, a printed graphics layer 22 on the outside surface of the binding layer 24 and a generally clear protection layer 20 on the outside surface of the printed graphics layer 22.

The bottom foam 26, which is also an optional layer as in the case of the deck foam 16, can have a preferred density of about 6 PCF and a preferred thickness of about 3 mm. The binding layer 24, which also serves as an adhesive to bond the printed graphics layer 22 to the foam, has a preferred thickness of about 0.3 mm. The protection layer 20 for the bottom surface of the board is preferably a slick PVC layer so that it can allow the board to slide on the snow surface. It may be a HDPE slick skin of about 0.5 mm.

FIGS. 3 (*a*) and (*b*) illustrate the front and back sides of an exemplary finished body board for sliding on a snow surface in accordance with the present invention. FIGS. 3 (*c*) and (*d*) illustrate the front and back sides of another exemplary finished body board for sliding on a snow surface. The top surface allows the underlying printed graphics layer to show through, thus decorating the board with eye-catching designs. The bottom layer, which also has a printed graphics layer underneath, provides the sliding surface. As can be appreciated, the body board in accordance with the present invention provides a much more eye-catching and stylish body board than the conventional boards.

It should be clear to those skilled in the art that further embodiments may be made without departing from the scope and spirit of the present invention.

I claim:

1. A body board, comprising:

a foam core portion having a top and bottom surface;

a binding layer laminated on the top surface of said foam core;

a first graphics layer laminated on the top of said binding layer; and a clear protection layer laminated on the top of said graphics layer.

2. The body board of claim 1, wherein said foam core is a polyethylene layer.

3. The body board of claim 2, wherein said clear protection layer has a rough surface texture.

4. The body board of claim 3, wherein said first graphics layer is preprinted with a predetermined design.

5. The body board of claim 2, wherein said clear protection layer has a generally smooth surface texture.

6. The body board of claim 3, wherein said foam core portion further comprises:

a LDPE foam core;

a deck foam on top of said center LDPE foam core.

7. The body board of claim 6, wherein said LDPE foam core has two layers of LDPE formed together, one of said layers having a first density and the other layer having a second density.

8. The body board of claim 1, further comprising:

a deck foam bonded to the bottom surface;

a slick PVC skin laminated on top of said deck foam.

9. A method of making a body board, comprising:

a) providing a foam core portion, said foam core having a top and bottom surface;

b) laminating a first binding layer on top of said top surface of said foam core portion;

c) laminating a first printed graphics layer on top of said first binding layer; and d) laminating a first clear protection layer on top of said printed graphics layer.

10. The method of claim 9, wherein:

said foam core portion is a deck foam bonded on top of a foam core, said deck foam having a higher density than said foam core.

11. The method of claim 10, said foam core portion further comprising a bottom foam bonded on the bottom of said foam core, said bottom foam having a thickness of about 3 mm and having a higher density than said foam core.

12. The method of claim 11, further comprising:

laminating second binding layer to the bottom foam;

laminating a second printed graphics layer to the second binding layer;

laminating a second protection layer to the second printed graphics layer.

13. The method of claim 12, wherein said second protection layer is a slick PVC layer.

* * * * *

US007160164C1

(12) EX PARTE REEXAMINATION CERTIFICATE (7758th)

United States Patent

Lin

(10) Number: US 7,160,164 C1

(45) Certificate Issued: *Sep. 21, 2010

(54) BODY BOARD

(75) Inventor: Joseph Lin, Torrance, CA (US)

(73) Assignee: Pacific Link Holdings Corp., Torrance, CA (US)

Reexamination Request:
No. 90/008,500, Mar. 15, 2007

Reexamination Certificate for:

| | |
|---|---|
| Patent No.: | **7,160,164** |
| Issued: | **Jan. 9, 2007** |
| Appl. No.: | **11/378,524** |
| Filed: | **Mar. 18, 2006** |

( * ) Notice: This patent is subject to a terminal disclaimer.

Related U.S. Application Data

(63) Continuation of application No. 10/606,433, filed on Jun. 25, 2003, now Pat. No. 7,029,349.

(51) Int. Cl.
*B63B 1/00* (2006.01)

(52) U.S. Cl. ..... 441/65; 441/74

(58) Field of Classification Search ..... None
See application file for complete search history.

(56) References Cited

U.S. PATENT DOCUMENTS

| | | | |
|---|---|---|---|
| 4,850,913 | A | 7/1989 | Szabad, Jr. |
| 5,211,593 | A | 5/1993 | Schneider |
| 5,238,434 | A | 8/1993 | Moran |
| 5,503,921 | A | 4/1996 | Chang |
| 5,882,776 | A | 3/1999 | Bambara |
| 6,106,345 | A | 8/2000 | Yeh |
| 6,358,599 | B1 | 3/2002 | Deibel |
| 7,083,173 | B2 | 8/2006 | Lehr |

FOREIGN PATENT DOCUMENTS

| | | |
|---|---|---|
| JP | 2000-117868 | 4/2000 |
| KR | 95-24351 | 9/1995 |
| KR | 96-4105 | 3/1996 |
| TW | 309741 | 7/1997 |

OTHER PUBLICATIONS

US Magistrate Judge Edward M. Chen, EMC Order Granting In Part And Denying In Part Defendant's Motion For Summary Judgment, dated Nov. 9, 2005, 17 pages. Case No. C–04–5055 EMC.

Attorney Jeremy M Duggan, Sport Dimension's Reply in Support of Motion for Summary Judgment of Non–Infringement of US Patent 5211593, Oct. 5, 2006, 15 pgs, Case No. C–04–5055 EMC.

*Primary Examiner*—Joseph A Kaufman

(57) ABSTRACT

A body board, or sports board, for recreational activities on snow or on water is disclosed. The board has a foam core, a binding layer laminated on top of one surface of the foam core, a printed graphics layer laminated on top of the binding layer and a clear protection layer laminated on top of the printed graphics layer. On the bottom surface of the board, the foam core can have a bottom foam layer applied thereto and a slick skin applied onto the outside of the bottom foam layer. The bottom surface can also have the graphics layer and binding layer applied between the bottom foam layer and the slick skin to provide an additional graphics side.

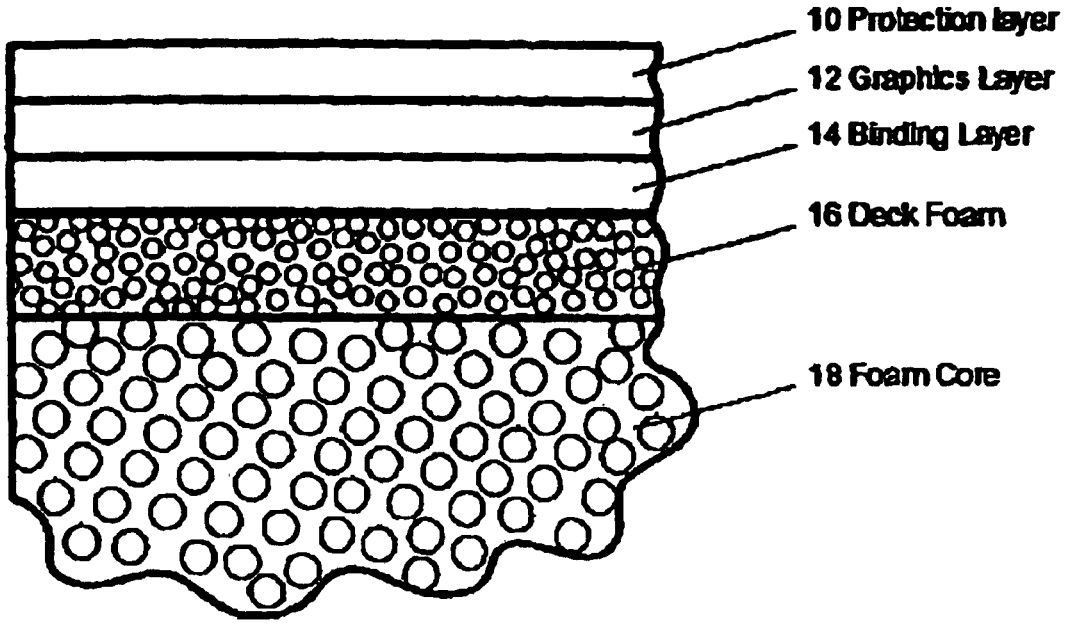

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1-5 and 9 is confirmed.

Claims 6-8 and 10-13 are cancelled.

* * * * *